US006652427B2

(12) United States Patent
Wroclawsky

(10) Patent No.: US 6,652,427 B2
(45) Date of Patent: Nov. 25, 2003

(54) TREADMILL RESISTANCE APPARATUS

(76) Inventor: Sol Wroclawsky, 5734 E. Scrivener St., Long Beach, CA (US) 90808

( * ) Notice: Subject to any disclaimer, the term of this patent is extended or adjusted under 35 U.S.C. 154(b) by 285 days.

(21) Appl. No.: 09/896,302

(22) Filed: Jun. 29, 2001

(65) Prior Publication Data

US 2003/0004038 A1 Jan. 2, 2003

(51) Int. Cl.[7] ..... A63B 23/02; A63B 21/02
(52) U.S. Cl. ..... 482/111; 482/54; 482/74
(58) Field of Search ..... 482/51, 74, 111, 482/112, 54; 244/142, 145

(56) References Cited

U.S. PATENT DOCUMENTS

| | | | | |
|---|---|---|---|---|
| 4,371,162 A | | 2/1983 | Hartzell | |
| 4,434,981 A | | 3/1984 | Norton | |
| 4,466,613 A | | 8/1984 | Reese | |
| 4,606,542 A | | 8/1986 | Segal | |
| 5,137,272 A | | 8/1992 | Wilkinson | |
| 5,167,601 A | | 12/1992 | Frappier | |
| 5,197,931 A | | 3/1993 | Wroclawsky | |
| 5,217,186 A | * | 6/1993 | Stewart et al. | 244/142 |
| 5,472,394 A | | 12/1995 | Michaelson | |
| 5,704,880 A | * | 1/1998 | Amatulle | 482/54 |
| 6,053,850 A | | 4/2000 | Martinez et al. | |
| 6,123,649 A | | 9/2000 | Lee et al. | |
| 6,146,315 A | | 11/2000 | Schonenberger | |
| 6,149,559 A | | 11/2000 | Mackey | |

* cited by examiner

*Primary Examiner*—Stephen R. Crow
(74) *Attorney, Agent, or Firm*—Dorsey & Whitney LLP

(57) ABSTRACT

The invention relates to an apparatus for use with a treadmill for exercising and strengthening the legs and the lower body of the user. The apparatus comprises a base that attaches to the treadmill, an elastomeric member that attaches to the user, and a flexible panel with means for adjusting the resistance exerted on the user.

6 Claims, 4 Drawing Sheets

TREADMILL RESISTANCE APPARATUS

FIELD OF THE INVENTION

This invention relates generally to the field of apparatus for exercising the human body. More particularly, the invention relates to an improved apparatus for use with a treadmill that provides a means for exercising against an elastomeric resistance, thereby strengthening the legs and the lower body, and increasing the legs' turnover.

BACKGROUND OF THE INVENTION

Human exercise on a regular basis is acknowledged to have many benefits. A large segment of the population prefers to exercise indoors for reasons of climate, personal convenience, shyness, etc. Athletes in training may also prefer to exercise indoors for reasons of climate and personal convenience.

The prior art has recognized the benefits of simulating indoors the benefits of exercise usually conducted out of doors, such as the cross-country skiing simulator as disclosed in the Norton U.S. Pat. No. 4,434,981; the running on stadium stairs for strengthening the legs and increasing cardiac output is simulated to a degree by the Wilkinson U. S. Pat. No. 4,340,218.

Rehabilitation or strengthening various leg joints of the body through use of elastomeric or spring resistance appears in the art such as the Segal U.S. Pat. No. 4,606,542 for exercising the legs or arms, the Hartzell U. S. Pat. No. 4,371,162 which simulates the weight lifters squats exercise, and Reese U.S. Pat. No. 4,466,613 for portable quadriceps muscles exerciser. Martinez U.S. Pat. No. 6,053,850 provides for a variable resistance exercise assembly that attaches to a shoulder harness.

Exercise apparatus for use with treadmills also appear in the art. For example, Frappier U.S. Pat. No. 5,167,601 provides for a leg muscle training device wherein stationary resistance is provided by a person grasping a tether firmly, and Lee U.S. Pat. No. 6,123,649 provides for an apparatus attached to a treadmill, with a resistance means that attaches to the user's body.

The present invention provides a simple and convenient apparatus that attaches easily to any treadmill device. When used in conjunction with the treadmill, the resistance is exerted directly to the user's legs, providing benefits similar to running in sand dunes or up stairs, namely increased leg strength, speed and thrust, as well as the overall endurance of the user. The addition of a flexible panel maintains the proper position and alignment of the user on the treadmill, provides a means to adjust the resistance exerted on the user, and provides a housing for the elastomeric member, thus preventing the elastomeric member from fluttering excessively.

SUMMARY OF THE INVENTION AND OBJECTS

It is an object of the present invention to provide an improved exercising device that increases overall endurance and leg strength by applying resistance to the legs while engaging in running or walking movements. It is another object of the invention to increase the leg turnover rate, thereby increasing a user's running speed, through the application of resistance to the legs while engaging in running or walking movements.

It is another object of the invention to provide an exercising device which may be used indoors with all commonly available treadmill devices, wherein the device is simple to manufacture and use, efficient in operation, disassembles easily for storage, is easy to erect for use in exercising.

These and other objects of the invention are realized by providing an resistance exercise apparatus to be used in conjunction with a belt driven treadmill, and includes a base that attaches to the treadmill and having a vertical strut positioned to be behind the user, with an elastomeric member yieldable to resist motions of the legs that is secured to the strut and is mountable on the user's legs.

A tether member that attaches to the user by means of a waist belt and extending to the strut defines the position and alignment of the user on the treadmill, and provides a means to adjust the resistance exerted on the user. A panel of flexible material houses the elastomeric member and further defines the position and alignment of the user on the treadmill.

Other objects, advantages and features of the invention become apparent from the following detailed description of the preferred embodiment, reference being made to the accompanying drawings.

DETAILED DESCRIPTION OF THE PREFERRED EMBODIMENTS

Figure 1:
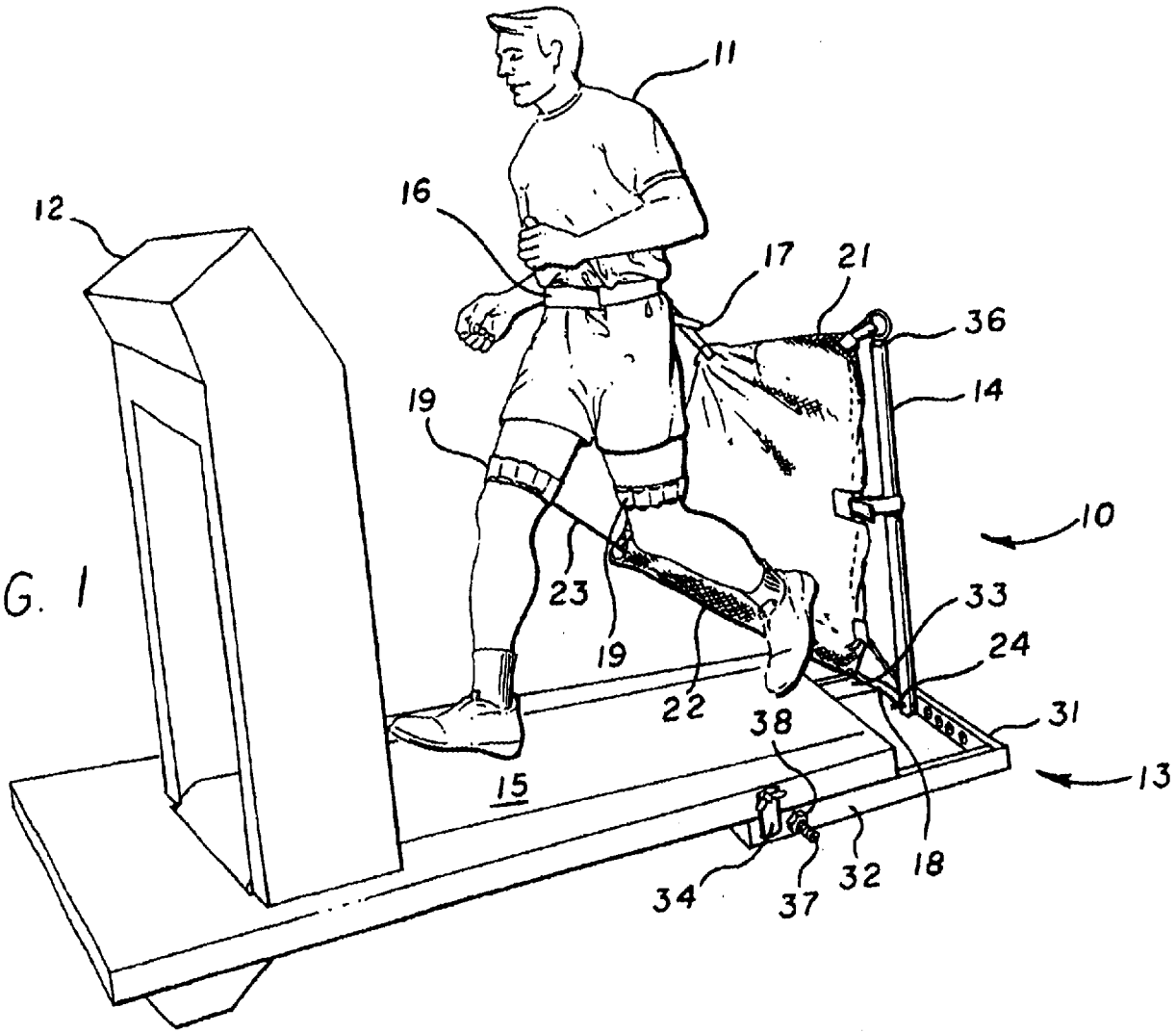
FIG. 1 is a side perspective view of an exercise apparatus according to the invention in use.

The exercise apparatus 10 of the present invention is shown in FIG. 1 of the drawings associated with a user 11. The apparatus 10 attaches to a treadmill 12 and is positioned behind the user 11 substantially medially of the driven treadmill belt 15. The apparatus includes a base 13; at least one vertical strut 14 extending upwardly from the base 13; a waist belt 16 mountable around the user's waist; a tether 17 that extends between the waist belt 16 and the vertical strut 14; and an elastomeric member 18 secured to the vertical strut 14, which engages with the user's legs by means of collars 19.

Figure 2:
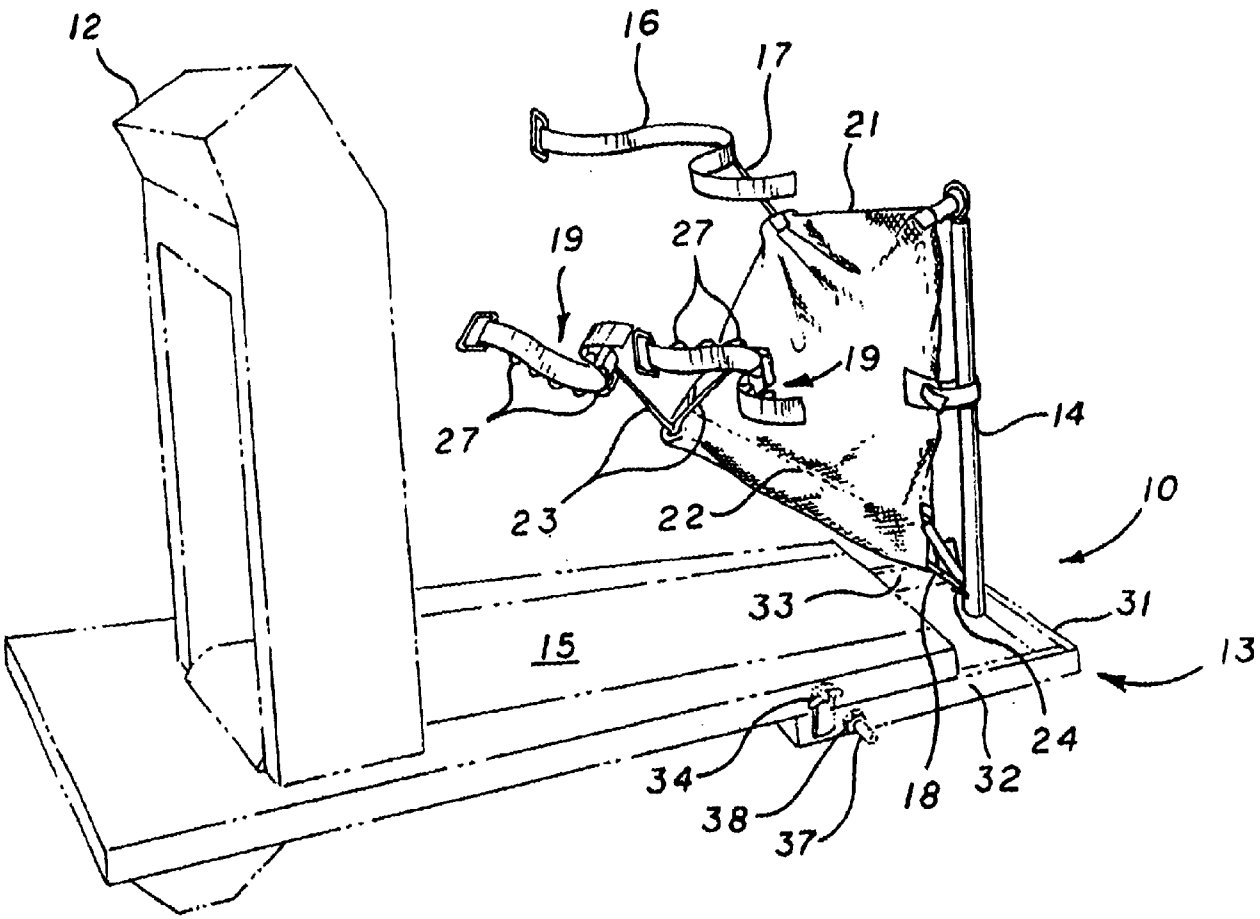
FIG. 2 is a side perspective view of the exercise device according to the invention, showing the base, vertical strut, elastomeric member; tether member, waist belt, leg collars, and flexible panel.

Referring to FIGS. 1 and 2, a panel 21 having a pocket 22 along the lower portion is attached to the vertical strut 14 at multiple points. The pocket 22 houses the elastomeric member 18, while the upper portion of the panel 21 extends between the tether 17 and the upper portion of the vertical strut 14. The panel 21 is substantially trapezoid in shape, and is made of substantially non-elastic, flexible material such as canvas or nylon fabric. Preferably the panel has means to releasably attach to the vertical strut 14. Besides housing the elastomeric member 18, the panel defines the position and alignment of the user on the treadmill in relation to the invention. Further, it serves to prevent the elastomeric member 18 from fluttering excessively during use.

The tether 17 is made of substantially non-elastic material such as woven canvas webbing, and may have means to adjust its length. Shortening the tether length will decrease the resistance exerted on the user, while lengthening the tether length will increase the resistance exerted on the user.

The elastomeric member 18 may be selected from various materials, including bungie cords, bicycle tire inner tubes, rubber straps and the like. The elastomeric member 18 is attached to the leg collars 19 by means of a v-shaped webbing 23, and includes means to attach to the vertical strut 14. The means to attach to the vertical strut is preferably a loop 24 that secures to a hook on the vertical strut 14.

Figure 3:
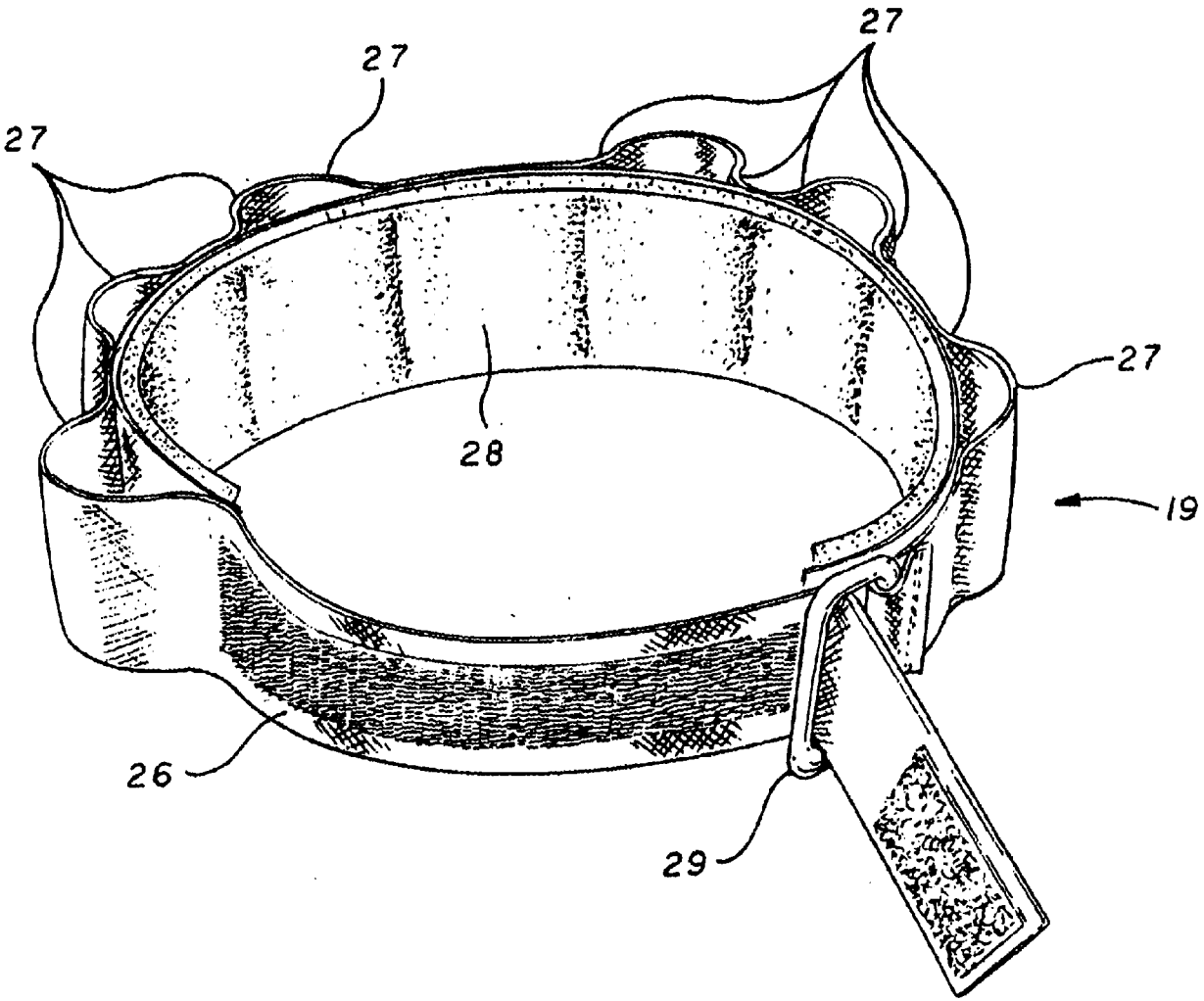
FIG. 3 is an enlarged view of a leg collar of the present invention.

Referring to FIG. 3, a leg collar 19 is mountable about the user's thigh and is comprised of a layer 26 of substantially non-elastic material, said layer further comprising a plurality of flexible loops 27 protruding from the external side of the layer, an elastic layer 28 attached to the internal side of the non-elastic layer 26, and fastening means to secure the collar around the user's thigh. When the collar is secured around the user's leg, the elastic layer 28 will be in contact with the user, and the loops 27 will flatten to provide a firm grip to the leg.

Preferably, the collar fastening means refers to a hook and loop type fastener attached to the one end of the non-elastic layer 26, that threads through a buckle 29.

The base 13, as shown in FIG. 1, comprises a rear support 31 from which the vertical strut 14 extends upwardly, a left support or arm 32, and a right support or arm 33 that are joined to the rear support. Both left and right supports are preferably L-shaped in lateral cross-section, and have means to releasably attach to the treadmill such as releasable clamps 34. The left and right supports 32, 33 unite with the rear support 31, to form a substantially u-shaped base with engagement means to achieve an adjustable or variable width to accommodate varied treadmill widths. Preferably, the support engagement means comprises multiple apertures bored through the left support 32, the right support 33, and the rear support 31, and fasteners. Preferably the fasteners are threaded bolts and nuts, but other fasteners such as cotter pins can be used, as well as other means to achieve adjustable width.

Figure 4:
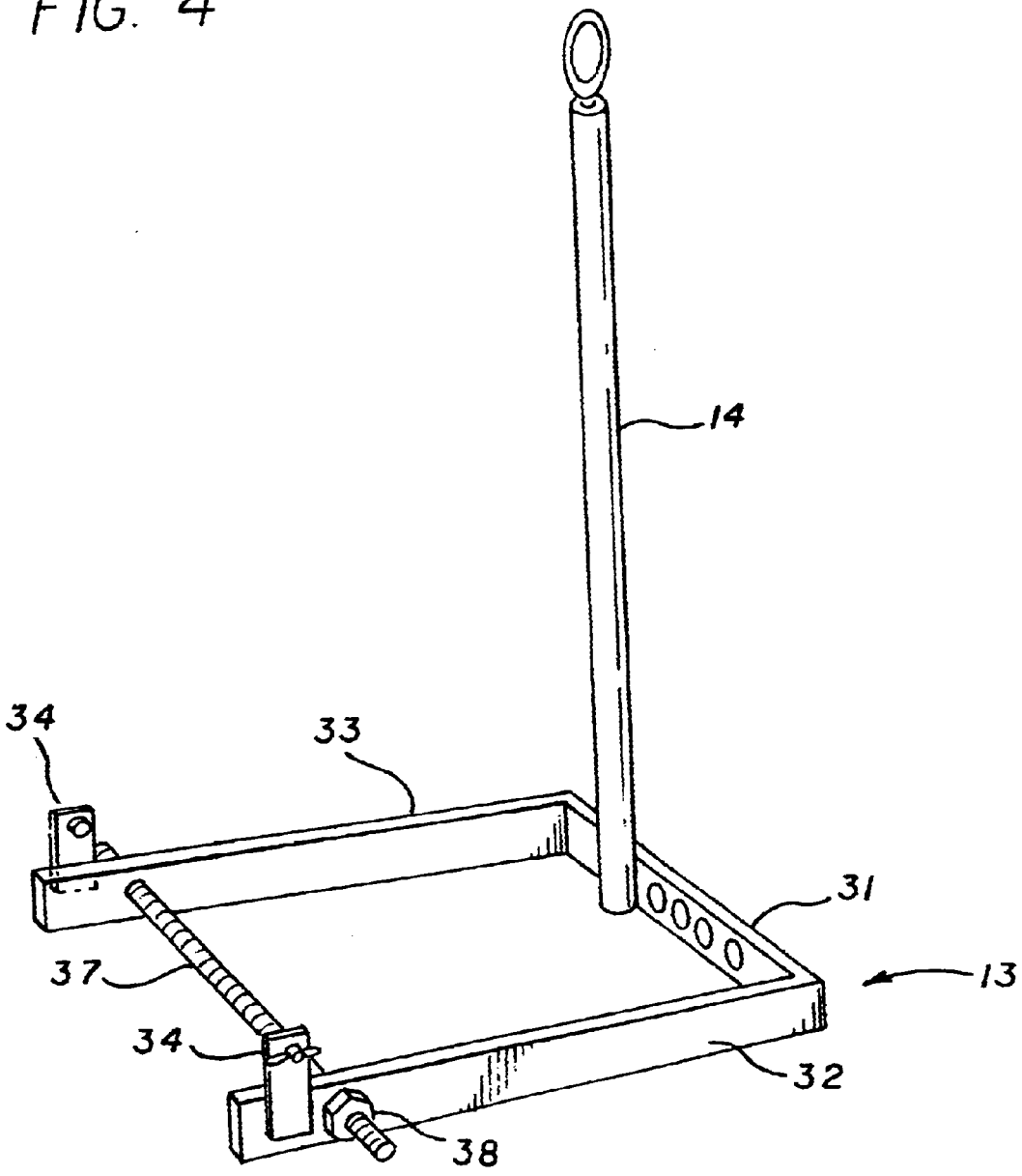
FIG. 4 is an overhead perspective view of the base of the present invention, showing the means to stabilize the left and right supports.

The base 13 may also include means to stabilize the left and right supports 32, 33, as shown in FIG. 4. Preferably, the means to stabilize the left and right supports 32, 33 comprises a threaded rod 37. The threaded rod 37 extends between the left support 32 and right support 33. The threaded rod 37 fits into apertures bored through the left support 32, the right support 33, and is securely fastened by means of a nut 38. The threaded rod 37 prevents the distortion or breaking of the left and right supports 32, 33 that may be caused by the force exerted by the releasable clamps 34.

The vertical strut 14 may include loop 36 that is secured to the top of the strut. The loop serves as an attachment point for the upper portion of the panel 21. The vertical strut may have other loops or hooks along its length that serve as attachment points for the panel 21.

The above apparatus can be used in the following methods. The apparatus 10 is secured to a treadmill 12 such as by the clamps 34, so that the base 13 rests on the ground, floor or other support surface, and is arranged to extend behind the user 11 and to the rear of the treadmill 12. The user 11 secures the waist belt 16 about the user's waist, and secures each leg collar 19 about the thigh of the user's legs. User moves his legs in a running or walking motion on the treadmill as the treadmill is set into operation. The elastomeric member 18 stretches from the force of the user's motion and exerts resistance on the user's legs. The application of resistance to the user's legs may have the effect of strengthening the user's legs and lower body. The application of resistance to the user's legs may also increase the user's leg turnover rate, thereby increasing the user's running speed.

As previously explained, shortening the length of tether 17 will decrease the resistance exerted on the user, while lengthening the length of tether 17 will increase the resistance exerted on the user. The resistance exerted on the user can also be adjusted by lengthening or shortening the left support 32 and right support 33 of the base 13 with respect to the end of the treadmill. It is understood that while adjusting the distance the base 13 extends behind the treadmill will modify the resistance exerted on the user, adjusting the length of the tether 17 provides a finer and quicker means for modifying the resistance exerted on the user.

It will be clear from the above that there has been described an improved apparatus which fulfills the purposes and objects of the invention, but it is to be understood that the form of the invention shown and described is to be taken as merely a preferred embodiment and various changes in shape, material, size and arrangement of the parts may be resorted to without departing from the spirit of the invention of scope of the claims which follow:

What is claimed is:

1. In association with a treadmill having a driven belt for human exercise, a variable resistance exercise apparatus comprising:

a base mountable at the access end of the treadmill, at least one vertical strut extending upwardly from said base substantially medially of the treadmill belt, a panel of flexible material secured at one end to such strut and having a pocket therein at a lower portion thereof, an elastomeric member extending through said pocket and secured to said strut, a pair of collars mountable on the user's thighs and means on said collars to attach to the elastomeric member, an waist belt mountable about the user's waist, and a tether member extending between the waist belt and the strut and serving to establish the user's forward most position on the treadmill belt, whereupon actuation of the treadmill, engagement of the user's legs stretches the elastomeric member, thereby applying resistance to the user's legs.

2. The apparatus of claim 1, wherein said collars mountable on the user's thighs each comprise:

a layer of substantially non-elastic webbing, said webbing further comprising a plurality of flexible loops protruding from the external side of the webbing, fastening means secured to ends of said webbing, and an elastic layer attached to the internal side of said webbing;

whereupon the internal side of said webbing faces the user's legs when collar is mounted on the user's leg, and said loops flatten to provide a firm grip to the leg.

3. The apparatus of claim 1, wherein said base comprises:

a rear support from which said vertical strut extends upwardly, a left support having one end releasably attached to the treadmill, and the other end having means to engage the rear support, and a right support having one end releasably attached to the treadmill, the other end having means to engage the rear support, wherein the rear support further comprises reciprocal means to attach the left support and right support; engagement of the rear support with the left support and the right support forms a substantially u-shaped base; and said means to engage the rear support allows adjustment of the base width to accommodate the treadmill width.

4. A method of increasing the strength and endurance of a user with a treadmill, comprising:

attaching the apparatus of claim 1 to a treadmill, so that the base rests on the ground and is arranged to extend predominantly aft of the user's legs;

securing the belt about the user's waist;

securing each collar around the thigh of the user's legs; and extending the user's legs in a running or walking motion so that the elastomeric member stretches and exerts resistance on the user's legs.

5. The method of claim 4, wherein adjusting the length of said tether modifies the resistance exerted on the user.

6. The method of claim 4, wherein lengthening or shortening said left support and said rear support of the base, so that the distance the base extends behind the treadmill is lengthened or shortened, modifies the resistance exerted on the user.

* * * * *